US010307637B2

(12) United States Patent
Nalley

(10) Patent No.: US 10,307,637 B2
(45) Date of Patent: Jun. 4, 2019

(54) EXERCISE MACHINE HAVING HORIZONTALLY EXTENDING AND SELECTIVELY CONNECTED WEIGHT PLATES

(71) Applicant: Mark Nalley, Murrieta, CA (US)

(72) Inventor: Mark Nalley, Murrieta, CA (US)

( * ) Notice: Subject to any disclaimer, the term of this patent is extended or adjusted under 35 U.S.C. 154(b) by 238 days.

(21) Appl. No.: 15/431,051

(22) Filed: Feb. 13, 2017

(65) Prior Publication Data

US 2018/0229076 A1 Aug. 16, 2018

(51) Int. Cl.
*A63B 21/00* (2006.01)
*A63B 23/12* (2006.01)
*A63B 21/062* (2006.01)

(52) U.S. Cl.
CPC ..... *A63B 23/12* (2013.01); *A63B 21/0626* (2015.10); *A63B 21/154* (2013.01); *A63B 21/4035* (2015.10)

(58) Field of Classification Search
CPC ..... A63B 21/00058; A63B 21/00065; A63B 21/00069; A63B 21/00072; A63B 21/00076; A63B 21/062; A63B 21/0624; A63B 21/0626; A63B 21/0628; A63B 21/063; A63B 21/0632; A63B 21/072; A63B 21/075; A63B 21/08; A63B 21/15; A63B 21/151; A63B 21/152; A63B 21/154; A63B 21/159; A63B 21/4027; A63B 21/4029; A63B 21/4031; A63B 21/4033; A63B 21/4035; A63B 21/4045; A63B 21/4047; A63B 21/4049; A63B 2244/09
See application file for complete search history.

(56) References Cited

U.S. PATENT DOCUMENTS 4,971,305 A * 11/1990 Rennex ..... A63B 21/063 482/93
5,039,092 A * 8/1991 Olschansky ..... A63B 21/04 482/130
5,074,551 A * 12/1991 Olschansky ..... A63B 21/04 482/130
D519,173 S * 4/2006 Nalley ..... D21/680
7,179,208 B1 * 2/2007 Nalley ..... A63B 21/063 482/98
7,435,206 B1 * 10/2008 Nalley ..... A63B 21/063 482/106
7,597,653 B1 * 10/2009 Lindemeier ..... A63B 21/155 482/129

(Continued)

*Primary Examiner* — Gary D Urbiel Goldner
(74) *Attorney, Agent, or Firm* — Morland C. Fischer

(57) ABSTRACT

A machine by which to enable a user to exercise his biceps by applying lifting forces to a pair of handles that are located at opposite sides of shrouded weight plate retention housing. Each lifting arm of the machine is coupled by way of a lifting cable to a respective weight plate carriage. Each weight plate carriage is responsive to a vertical uplifting force applied thereto by the lifting cable to lift a plurality of weight plates that are arranged in parallel side-by-side alignment in a horizontal direction. The plurality of weight plates have different lengths and correspondingly different weights (e.g., from 5 to 20 pounds). Each weight plate has a locking cartridge connected thereto. By pushing control knobs of the locking cartridges, some or all of the weight plates can be selectively connected to the weight plate carriage to be lifted thereby.

20 Claims, 14 Drawing Sheets

(56) References Cited

U.S. PATENT DOCUMENTS 7,608,021 B1 * 10/2009 Nalley ..... A63B 21/0628 482/98
7,850,580 B2 * 12/2010 Johnson ..... A63B 21/0552 482/121
7,887,468 B2 * 2/2011 Ross ..... A63B 21/055 482/92
8,007,415 B1 * 8/2011 Lundquist ..... A63B 21/075 482/107
8,047,970 B2 11/2011 Nalley
D692,073 S * 10/2013 Nalley ..... A63B 21/0728 D21/680
8,568,279 B2 * 10/2013 Golesh ..... A63B 21/0728 482/104
8,845,498 B2 * 9/2014 Webb ..... A63B 21/00065 482/107
8,876,674 B2 * 11/2014 Webb ..... A63B 21/0628 482/102
8,968,167 B1 * 3/2015 Abelbeck ..... A63B 21/0442 482/129
2005/0085351 A1 * 4/2005 Kissel ..... A63B 21/06 482/94
2008/0039302 A1 * 2/2008 Grant ..... A63B 21/04 482/121
2009/0048079 A1 * 2/2009 Nalley ..... A63B 21/0728 482/107
2009/0075791 A1 * 3/2009 Kissel ..... A63B 21/155 482/93
2009/0149301 A1 * 6/2009 Johnson ..... A63B 21/0552 482/98
2010/0009819 A1 * 1/2010 Nalley ..... A63B 21/063 482/98
2010/0285933 A1 * 11/2010 Nalley ..... A63B 21/0615 482/94
2011/0245048 A1 * 10/2011 Nalley ..... A63B 21/0615 482/107
2012/0004080 A1 * 1/2012 Webb ..... A63B 21/00065 482/97
2012/0010055 A1 * 1/2012 Webb ..... A63B 21/063 482/98
2012/0021877 A1 * 1/2012 Lundquist ..... A63B 21/0728 482/107
2013/0296142 A1 * 11/2013 Robertson ..... A63B 71/0622 482/98
2014/0106943 A1 * 4/2014 Simonetti ..... A63B 71/0036 482/98
2014/0274596 A1 * 9/2014 Krull ..... A63B 21/0724 482/107
2015/0133274 A1 * 5/2015 Simonetti ..... A63B 21/063 482/98
2015/0367162 A1 * 12/2015 Mueller ..... A63B 21/0058 482/94
2016/0151658 A1 * 6/2016 Nalley ..... A63B 21/063 482/107
2017/0259103 A1 * 9/2017 Simonetti ..... A63B 21/063

* cited by examiner

EXERCISE MACHINE HAVING HORIZONTALLY EXTENDING AND SELECTIVELY CONNECTED WEIGHT PLATES

BACKGROUND OF THE INVENTION

1. Field of the Invention

This invention relates to an exercise machine having particular application for enabling a user to exercise his biceps during an exercise routine. By applying pulling forces to a pair of handles of the machine, a user can lift a pair of weight plate carriages and one or more vertically upstanding weight plates from respective horizontally extending pluralities of weight plates that are selectively connected to the weight plate carriages.

2. Background Art

Conventional exercise machines typically include a vertical stack of weight plates positioned one on top of the other which have a set of bore holes therethrough and which are known to those in the art as a selectorized weight stack. A pair of guide rods pass through respective side bore holes to create a vertical track along which the stack of weight plates can ride. A center post passes through another bore hole at the center of the stack, and a selector pin is inserted through one of a series of pin holes formed in the center post so that a particular number of weight plates from the stack can be lifted by the user. The number of weight plates and the total weight to be lifted during any exercise will depend upon the particular pin bole along the center post into which the selector pin is inserted. A pulling force applied by the user to a cable which communicates with the center post will generate a lifting force which can be repeated a number of times to cause any number of weight plates from the stack to be lifted depending upon the location of the selector pin relative to the center post.

It can be appreciated that the aforementioned weight plate lifting exercise machine having a pair of guide rods to be received through the side bore holes of each weight plate will be noisy to use and have relatively high maintenance costs. That is, it will be necessary from time-to-time to clean and lubricate the guide rods to ensure that the weight plates will slide easily therealong. Moreover, the selector pin is removable from the center post of the weight plate lifting exercise machine following a workout. Consequently, the selector pin is known to be lost, stolen or damaged which can interfere with the ability to use the machine on an as-needed basis. In cases where the selector pin is not immediately available, substitutes have sometimes been used which may be functionally and/or structurally inadequate to ensure that the apparatus will be properly and safely used.

Accordingly, an improvement to the conventional weight plate lifting exercise machine is desirable in order to overcome the shortcomings described above by reducing noise and eliminating the requirement for a center post, the guide rods, and a selector pin to cooperate with the center post.

SUMMARY OF THE INVENTION

In general terms, an exercise machine is disclosed by which to enable a user to exercise his biceps. The machine includes a shrouded weight plate retention housing having an upstanding barrier at each side thereof. Located adjacent each upstanding barrier is an identical weight plate carriage that is adapted to lift in a vertical direction one or more vertically upstanding weight plates from a horizontally extending plurality of weight plates that are arranged in parallel side-by-side alignment with one another. The weight plates have different lengths and correspondingly different weights (e.g., from 5 to 20 pounds). A lifting cable is connected at one end thereof to the top of a weight plate carriage positioned at one side of the weight plate retention housing. The opposite end of the lifting cable is wrapped around a weight plate carriage lifting cam. A coupling rod connects the cam to a lifting arm of the exercise machine. A lifting force applied by one arm of the user to a handle end of the lifting arm during an exercise routine causes the lifting arm and the cam to rotate, whereby to impart a vertical uplifting three to the weight plate carriage by way of the lifting cable in order to lift the carriage and any of the weight plates that are selectively connected thereto.

A weight plate lifting block is affixed to the top of the weight plate carriage. A pair of engagement pin receiving holes are formed in the lifting block. The lifting block is received within a lifting cavity that is formed in each of the first (e.g., 5 pounds) and second (e.g., 10 pounds) weight plates from the horizontally extending plurality of weight plates. Each of the first and second weight plates has an identical locking cartridge connected at one side thereof. A user actuated control knob communicates with an engagement pin that is located within and slidable through the locking cartridge. When the user moves the control knob from an unlocked position to a locked position, the engagement pin is correspondingly pushed from a retracted position withdrawn inwardly of the locking cartridge to an extended position projecting outwardly from the locking cartridge for receipt by a respective one of the pair of engagement pin receiving holes formed in the lifting block, whereby one or both of the first and second weight plates are selectively connected to the weight plate carriage to be lifted thereby depending upon the position of the control knobs of the locking cartridges.

A weight plate clasp (e.g., a hook) is pivotally connected to and rotated by a torsion spring forwardly of the weight plate lifting block at the top of the weight plate carriage. A third weight plate (e.g., 20 pounds) from the horizontally extending plurality of weight plates has a hook retaining cavity formed therein in which the weight plate hook is positioned. A locking cartridge is connected to one side of the third weight plate. When a user moves a control knob from an unlocked position to a locked position, an engagement pin is correspondingly pushed outwardly from the locking cartridge and into the hook retaining cavity of the third weight plate within which to capture the hook end of the weight plate hook that is pivotally connected to the weight plate lifting block, whereby the third weight plate is connected to the weight plate carriage to be lifted thereby.

Each of the third and remaining weight plates (e.g., 20 pounds) from the horizontally extending plurality of weight plates has a rotatable weight plate clasp (e.g., a hook) pivotally connected thereto at the hook retaining cavity thereof to be rotated by a torsion spring into the hook retaining cavity of a succeeding weight plate. A locking cartridge is connected to one side of each of the fourth and additional ones of the weight plates. When the user moves a control knob from the locking cartridge connected to any one of these weight plates from an unlocked position to a locked position, an engagement pin is correspondingly pushed outwardly from the locking cartridge and into the hook retaining cavity of the weight plate to which the locking cartridge is connected. The engagement pin captures the hook end of the rotatable weight plate hook that is pivotally connected to the preceding (e.g., the third) weight plate, whereby the succeeding (e.g., the fourth) weight plate is selectively connected to the preceding weight plate and to the weight plate carriage so that each of the fourth and remaining weight plates can be lifted depending upon the position of the control knobs of the respective locking cartridges.

DESCRIPTION OF THE PREFERRED EMBODIMENT

Figure 1:
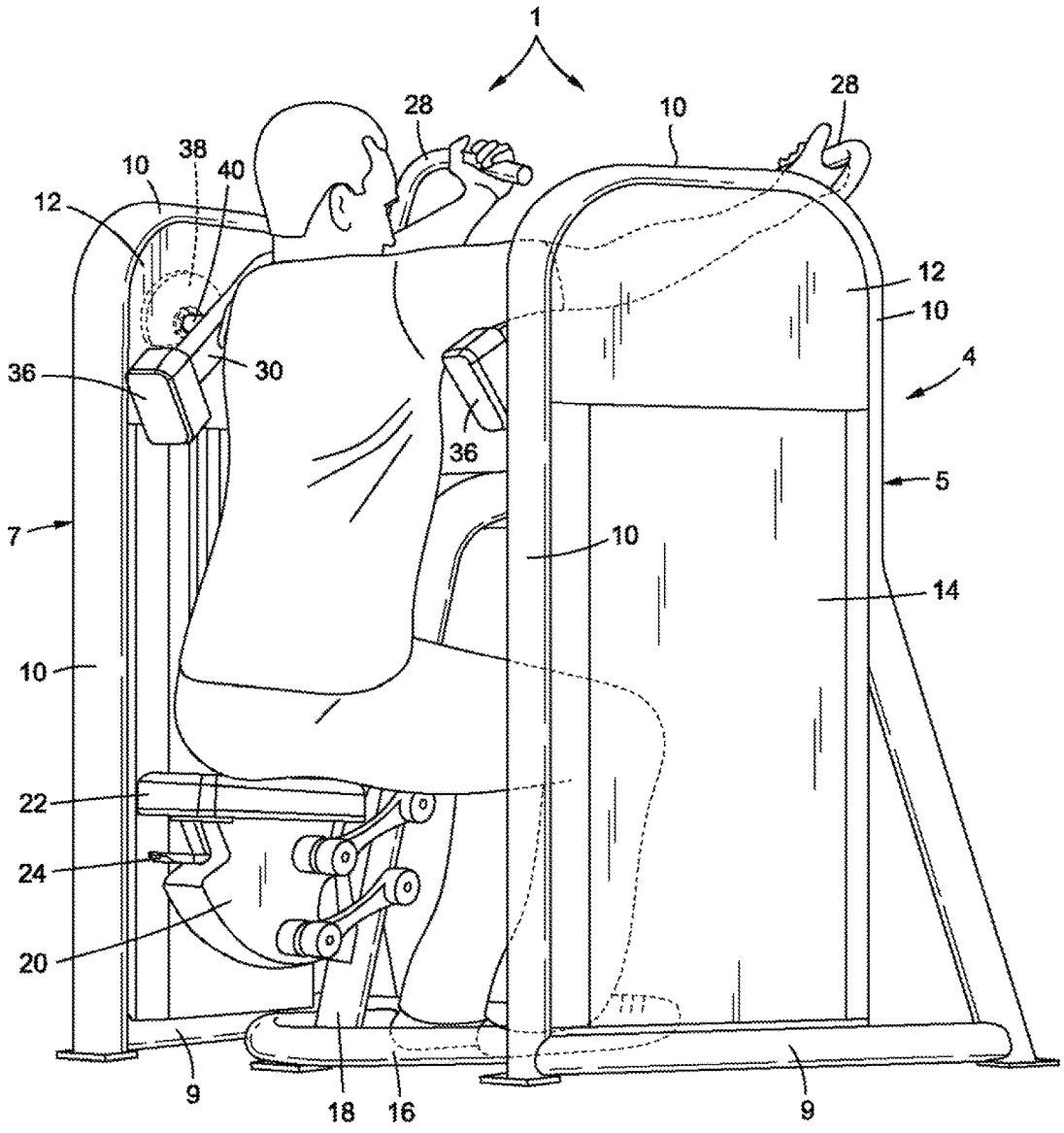
FIGS. 1 and 2 show an exercise machine by which a user can exercise his biceps by lifting one or more weight plates from horizontally extending pluralities of weight plates that are selectively connected to and lifted by weight plate carriages located at opposite sides of the machine.
Figure 2:
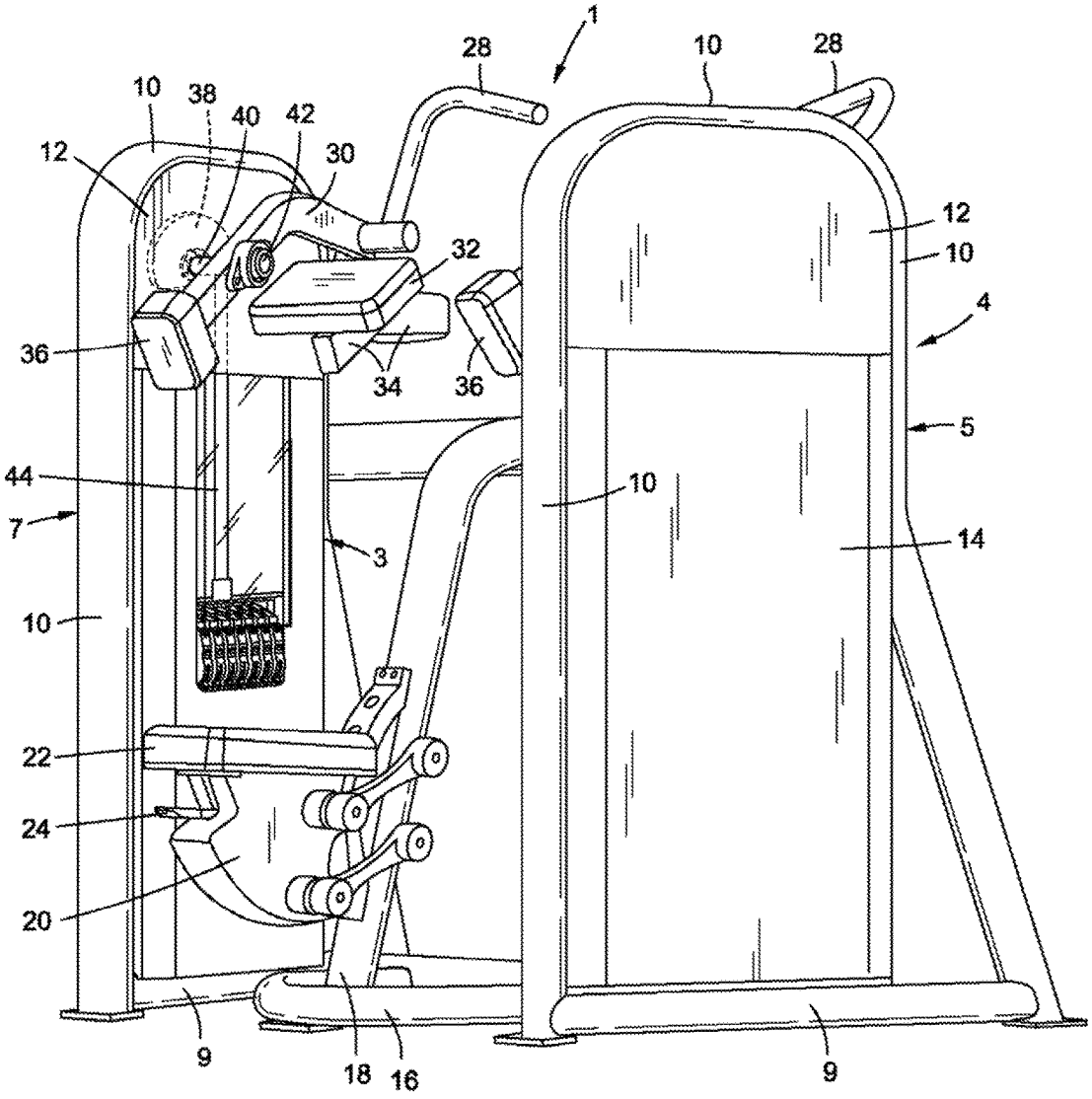

A machine 1 by which to enable a user to exercise his biceps is initially described while referring to FIGS. 1 and 2 of the drawings. The exercise machine 1 shown in FIGS. 1 and 2 is commonly found and used in a gym as part of a fitness and exercise routine. As will soon be explained, the exercise machine includes a pair of weight plate carriages (designated 3 in FIG. 2) each of which having a plurality of (e.g., rectangular) vertically upstanding weight plates that are aligned side-by-side one after another so as to extend horizontally across the weight plate carriage. As will also be explained, the weight plates from each plurality thereof have a variety of different lengths and correspondingly different weights to be selectively lifted with the weight plate carriage 3 by which the user can adjust the total weight lifted and thereby control the intensity of the workout according to his needs and capability.

The exercise machine 1 includes a shrouded weight plate retention housing 4 having a pair of upstanding barriers 5 and 7 located at opposite sides of the housing 4. Each of the upstanding barriers 5 and 7 is surrounded by a tubular steel frame member 9 running along the bottom and a tubular steel frame member 10 running continuously around the sides and top. Each upstanding barrier 5 and 7 that is surrounded by the tubular frame members 9 and 10 includes an upper shrouded section 12 and a lower shrouded section 14. The upper and lower shrouded sections 12 and 14 of the barriers 5 and 7 are preferably manufactured from plastic or metal and provide the sides of the weight plate retention housing 4 of the exercise machine 1 with continuous walls to prevent the user's hands and arms from extending outside the housing.

Another tubular steel frame member 16 is located between the upstanding barriers 5 and 7 of the weight plate retention housing 4. Standing upwardly from frame member 16 is a seat adjustment post 18. A 4-bar linkage 20 is coupled between the seat adjustment post 18 and a padded seat 22 upon which the user of the exercise machine 1 is seated. Once a position control lever 24 is depressed, the 4-bar linkage 20 allows the elevation of the seat 22 to be adjusted according to the needs and size of the user.

The exercise machine 1 includes a pair of identical handles 28 to be gripped by the hands of the user wishing to lift those weight plates which are carried by the weight plate carriages 3. Since they are identical, only one handle 28 and its interconnection with one weight plate carriage 3 at one side of the weight plate retention housing 4 will be described. As is best shown in FIG. 2, the handle 28 bends upwardly and outwardly from a lifting arm 30. The lifting arm 30 extends above art elbow pad 32 that is seated upon an elbow pad support 34 that is affixed to the upstanding barrier 7 of the weight plate retention housing 4. One elbow of the user rests upon the elbow pad 32 when the user applies a pulling farce to the handle 28 by which to lift selected ones of the weight plates that are carried by the weight plate carriage 3 at one side of housing 4 in a manner that will soon be disclosed. The lifting arm 30 is connected at one end thereof to the handle 28 and at the opposite end to a counter weight 36.

A rotatable weight plate carriage lifting cam 38 is located between the upper shrouded section 12 of the upstanding barrier 7 at one side of the weight plate retention housing 4 and the lifting arm 30. A coupling rod 40 extends outwardly from the shrouded section 12 to pass through the rotatable cam 38 and through the lifting arm 30 to which an end cap 42 is connected to establish a pivot approximately midway between the handle 28 and the counter weight 36 at opposite ends of arm 30. The lifting arm 30 is adapted to rotate back and forth at the pivot in response to a pulling force applied by the user to the handle 28. Inasmuch as the rotatable cam 38 is coupled to the lifting arm 30 by the coupling rod 40, a rotation of the lifting arm 30 causes a simultaneous rotation of both the cam 38 and the coupling rod 40.

A weight plate carriage lifting cable or belt 44 is connected at one end thereof to the weight plate carriage 3 and at the opposite end to the rotatable weight plate carriage lifting can 38. Accordingly, a rotation of the rotatable cam 38 with the coupling rod 40 and the lifting arm 30 in response to a pulling force applied by the user to the handle 28 will cause a linear uplifting force to be applied to the weight plate carriage 3 by way of the cable 44 whereby to lift the weight plate carriage 3 and selected ones of the weight plates.

Figure 3:
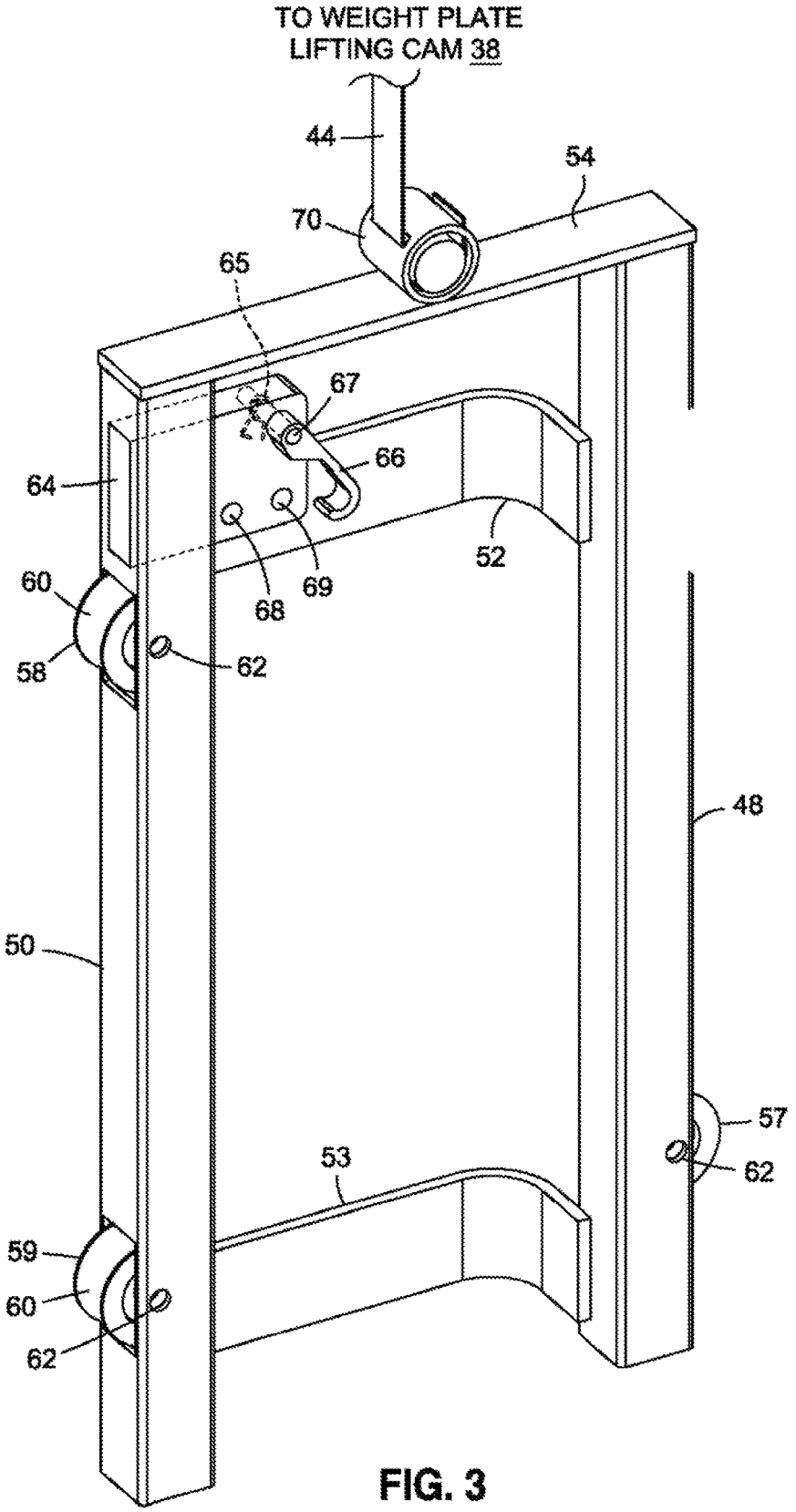
FIG. 3 shows details of a weight plate carriage located at one side of the machine of FIGS. 1 and 2 to which the weight plates front one horizontally extending plurality of weight plates are selectively connected.

Referring to FIG. 3 of the drawings, details are disclosed concerning the weight plate carriage 3 that is located adjacent the upstanding barrier 7 at one side of the exercise machine 1. As indicated earlier, an identical weight plate carriage (not shown) is located at the opposite side of the exercise machine 1. The weight plate carriage 3 includes a pair of vertical carriage alignment columns 48 and 50 running along the opposite sides thereof. Upper and lower spacing flanges 52 and 53 extend between the carriage alignment columns 48 and 50 to hold the columns in spaced parallel alignment. A top plate 54 extends across the top of the weight plate carriage 3 between the alignment columns 48 and 50.

Upper and lower ball bearing loaded rollers 56 and 57 are partially recessed within and rotatably connected to the outwardly facing side of the carriage alignment column 48. Upper and lower ball bearing loaded rollers 58 and 59 are also partially recessed within and rotatably connected to the outwardly facing side of the carriage alignment column 50. Each of the pairs of upper and lower rollers 56, 57 and 58, 59 has a radiused guide track 60 running circumferentially therearound. The upper and lower rollers 56-59 are rotatably connected to the carriage alignment columns 48 and 50 of the weight plate carriage 3 by means of respective bolts (not shown) that are received by the alignment columns through bolt holes 62 formed therein.

Recessed partially within and affixed (e.g., welded) to one of the carriage alignment columns 50 at the top of and at one side of the weight plate carriage 3 is a weight plate lifting block 64. The weight plate lifting block 64 holds a hook-shaped weight plate clasp 66 at the top of the weight plate carriage 3. The weight plate clasp 66 is pivotally connected to lifting block 64 by means of a (e.g., shoulder) bolt 67 for a purpose that will soon be explained. A pair of engagement pin receiving holes 68 and 69 are formed through the lifting block 64.

One end of the aforementioned weight plate carriage lifting cable 44 is connected to the rotatable weight plate carriage lifting cam (38 of FIGS. 1 and 2). The opposite end of the lifting cable 44 is wrapped around and connected to a cable lock 70. The cable lock 70 is affixed (e.g., welded) to the top plate 54 that extends across the top of the weight plate carriage 3. Thus, and as was previously described when referring to FIGS. 1 and 2, a pulling three applied by the user of the exercise machine to the handle 28 imparts a rotation to the rotatable weight carriage lifting cam 38 which, in turn, causes a linear uplifting pulling force to be applied to the lifting cable 44, whereby the weight plate carriage 3 and selected ones of the weight plates carried thereby are lifted as part of the user's exercise routine.

Figure 4:
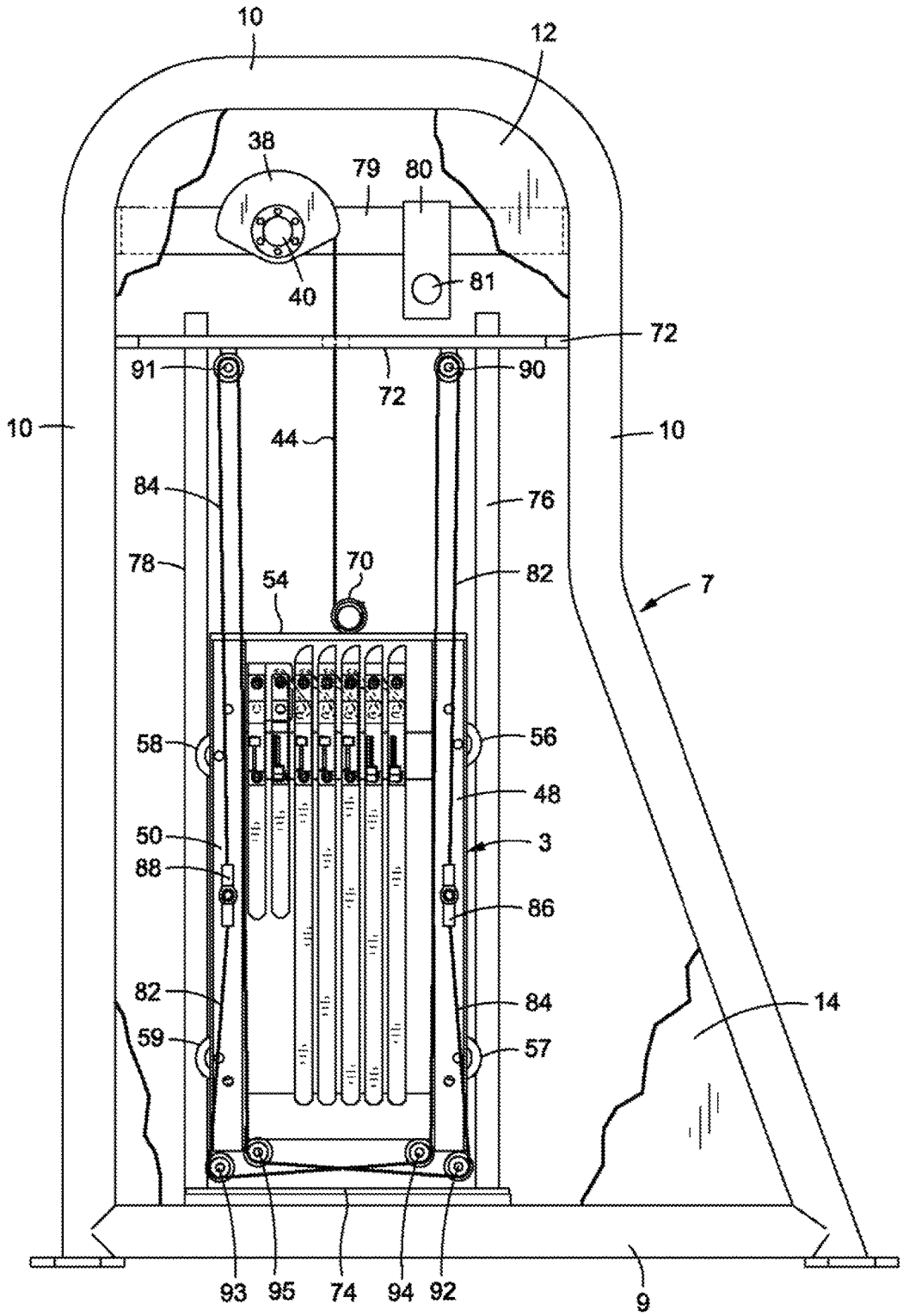
FIG. 4 shows one weight plate carriage and the horizontally extending plurality of weight plates thereof in an at-rest position with no uplifting pulling force being applied to the carriage.
Figure 5:
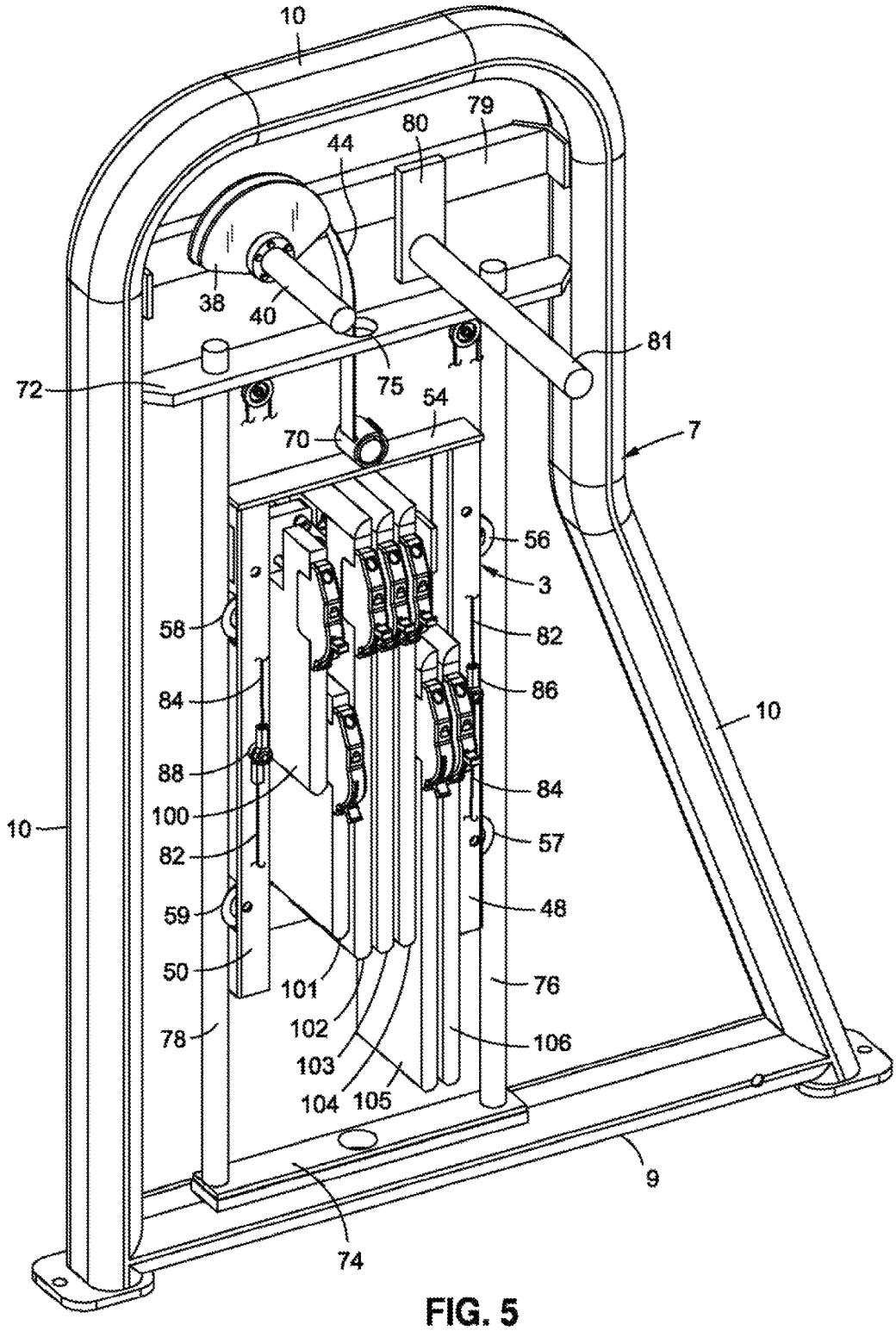
FIGS. 5 and 6 show the weight plate carriage of FIG. 4 and the weight plates which have been selectively connected thereto being lifted in a vertical direction after an uplifting pulling force has been applied to the carriage.
Figure 6:
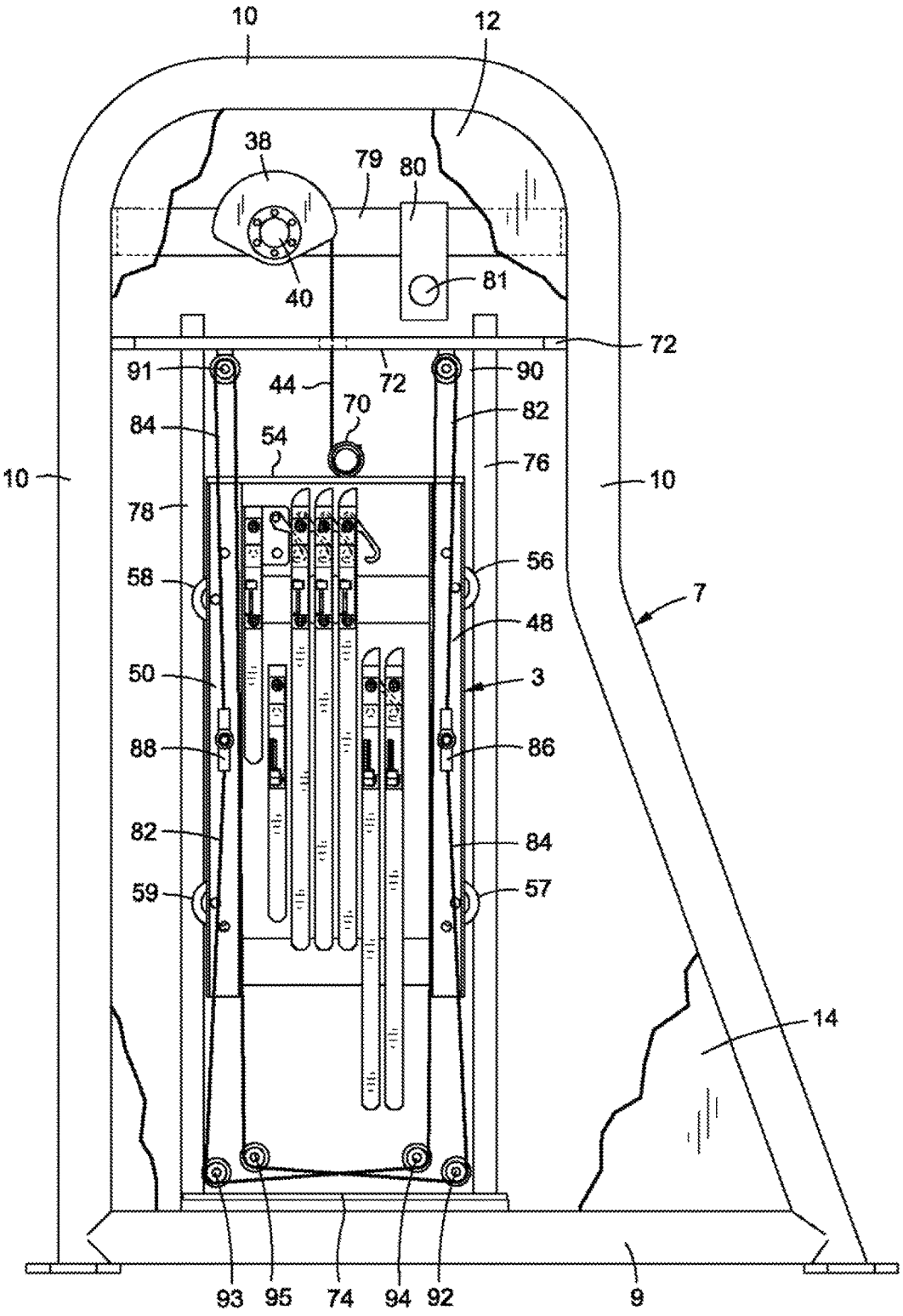

FIGS. 4-6 of the drawings illustrate the weight plate carriage 3 connected to one of the upstanding barriers 7 located at one side of the shrouded weight plate retention housing (designated 4 in FIGS. 1 and 2) of the exercise machine 1. The weight plate carriage 3 is shown in FIG. 4 at-rest with no pulling force being applied to lifting cable 44, and the weight plate carriage 3 is shown in FIGS. 5 and 6 after being lifted in response to a pulling force applied to cable 44. An upper carriage stabilizer plate 72 extends laterally across the upstanding barrier 7 between the frame member 10 at opposite sides thereof. A lower carriage stabilizer plate 74 is affixed (e.g., welded) to the frame member 9 at the bottom of barrier 7. The weight carriage lifting cable 44 is connected from the cable lock 70 at the top of the weight plate carriage 3 to the weight plate carriage lifting cam 38 by way of a hole 75 formed through the upper carriage stabilizer plate 72.

A first carriage stabilizer post 76 extends vertically through the upstanding barrier 7 between the upper and lower carriage stabilizer plates 72 and 74 thereof so as to lie adjacent one side of the weight plate carriage 3. A second carriage stabilizer post 78 also extends vertically through the barrier 7 between the upper and lower carriage stabilizer plates 72 and 74 so as to lie adjacent the opposite side of the weight plate carriage 3. The first and second carriage stabilizer posts 76 and 78 are (e.g. cylindrically) shaped to be received within the radiused guide tracks (designated 60 in FIG. 3) from the pairs of upper and lower rollers 56, 57 and 58, 59 that are rotatably connected to the carriage alignment columns 48 and 50 at opposite sides of the weight plate carriage 3.

A horizontal pivot support brace 79 extends laterally across the top of the upstanding barrier 7 between the frame member 10 at opposite sides of the barrier 7 so as to lie above the upper carriage stabilizer plate 72. The previously described coupling rod 40 projects inwardly from the pivot support brace 79 of the barrier 7 to be received through the lifting arm 30 which lies above the elbow pad 32 (of FIG. 2). As was earlier explained, a pivot axis is created by coupling rod 40 around which the lifting arm 30 is rotated in response to a pulling force applied by the user to the handle 28 connected to lifting arm 30.

An elbow pad support bracket 80 is also affixed to the pivot support brace 79 adjacent the coupling rod 40. An elbow pad support rod 81 projects from the elbow pad support bracket 80 to be connected to the elbow pad support 34 (of FIG. 2) by which to hold the elbow pad 32 in place below the lifting arm 30 so as to withstand the pressure of the user's elbow thereupon.

As was also previously explained, the weight plate carriage 3 and any of a number of weight plates that are selectively coupled thereto are lifted as a unit in response to an uplifting pulling force being applied by the weight plate carriage lifting cable 44 to the cable lock 70 atop the carriage 3. The weight plate carriage 3 is repeatedly lifted and lowered during successive exercise cycles by way of a pair of carriage guide cables 82 and 84. First ends of the carriage guide cables 82 and 84 are connected to one another at a first eyeball tie rod hushing 86 located at one side of the weight plate carriage 3. Opposite ends of the carriage guide cables 82 and 84 are connected to one another at a second eyeball tie rod bushing 88 located at the opposite side of the carriage 3.

A pair of upper cable pulleys 90 and 91 are affixed to the upper carriage stabilizer plate 72 so as to be spaced from one another above the weight plate carriage 3. A first pair of lower cable pulleys 92 and 93 are affixed to the tubular steel frame member 9 at the bottom of the upstanding barrier 7 so as to be spaced from one another below the weight plate carriage 3. The upper cable pulley 90 is axially aligned with the lower cable pulley 92 at one side of the carriage 3, and the upper cable pulley 91 is axially aligned with the lower cable pulley 93 at the opposite side of the carriage 3. A second pair of lower cable pulleys 94 and 95 are also affixed to the frame member 9 of barrier 7 so as to be spaced from one another below the carriage 3. However, the second pair of lower cable pulleys 94 and 95 are spaced inwardly of and slightly above the first pair of lower cable pulleys 92 and 93.

The first 82 of the pair of carriage guide cables extends from the first tie rod bushing 86 located at one side of the weight plate carriage 3 to run up, over and around the upper cable pulley 90, down and under the lower cable pulley 94 from the second pair thereof, under the lower cable pulley 93 from the first pair thereof, and up to the second tie rod bushing 88 located at the opposite side of the carriage 3. The second 84 of the pair of carriage guide cables extends from the second tie rod bushing 88 located at the opposite side of the weight plate carriage 3 to run up, over and around the upper cable pulley 91, down and under the lower cable pulley 95 from the second pair thereof, under the lower cable pulley 92 from the first pair thereof, and up to the first tie rod bushing 86 located at the first side of the carriage 3.

Figure 7:
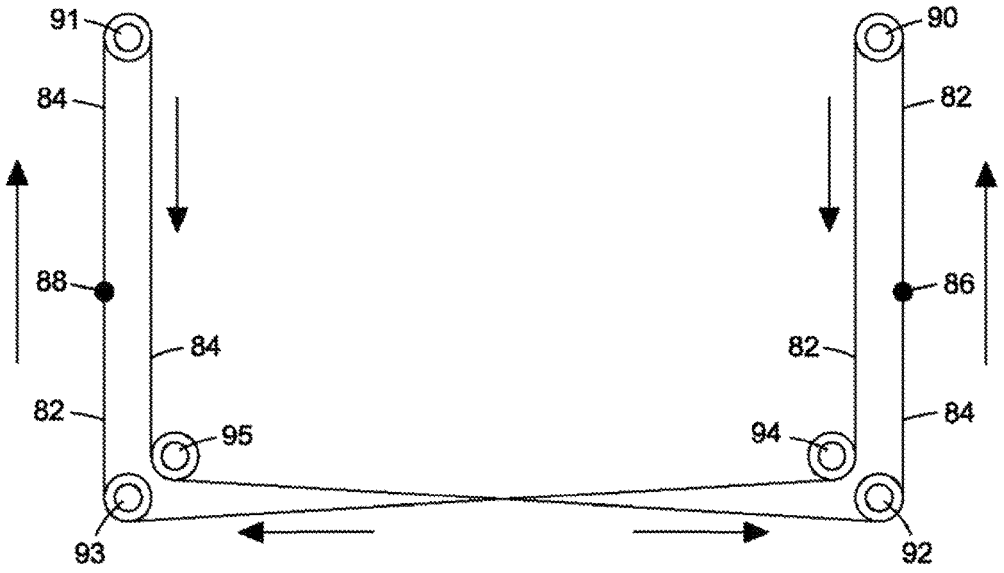
FIG. 7 shows the directions in which a pair of carriage guide cables are moved when the uplifting pulling force is applied to the weight plate carriage of FIGS. 5 and 6 to lift the carriage in the vertical direction.

The first and second eyeball tie rod bushings 86 and 88 are attached to opposite sides of the weight plate carriage 3 so as to be carried by the carriage as it moves up and down relative to the first and second carriage stabilizer posts 76 and 78 during successive exercise cycles in response to repetitive pulling forces applied by the user to the handlebars (designated 28 in FIG. 1). As the weight plate carriage 3 moves up and down, the pairs of upper and lower rollers 56, 57 and 58, 59 roll over the first and second carriage stabilizer posts 76 and 78 which are fixed in place between the upper and lower carriage stabilizer plates 72 and 74. FIG. 7 of the drawings shows the directions in which the carriage guide cables 82 and 84 move as the weight plate carriage 3 is pulled by the weight plate carriage lifting cable 44 upwardly through the weight plate retention housing (designated 4 in FIG. 1) to a lifted position shown in FIGS. 5 and 6. As shown by the cable matrix of FIG. 7, the cables 82 and 84 work against one another (i.e., move in opposite directions) to ensure that the weight plate carriage 3 will remain horizontally level and avoid shifting to one side or the other regardless of the magnitude of the weight that is lifted by the carriage.

Figure 8:
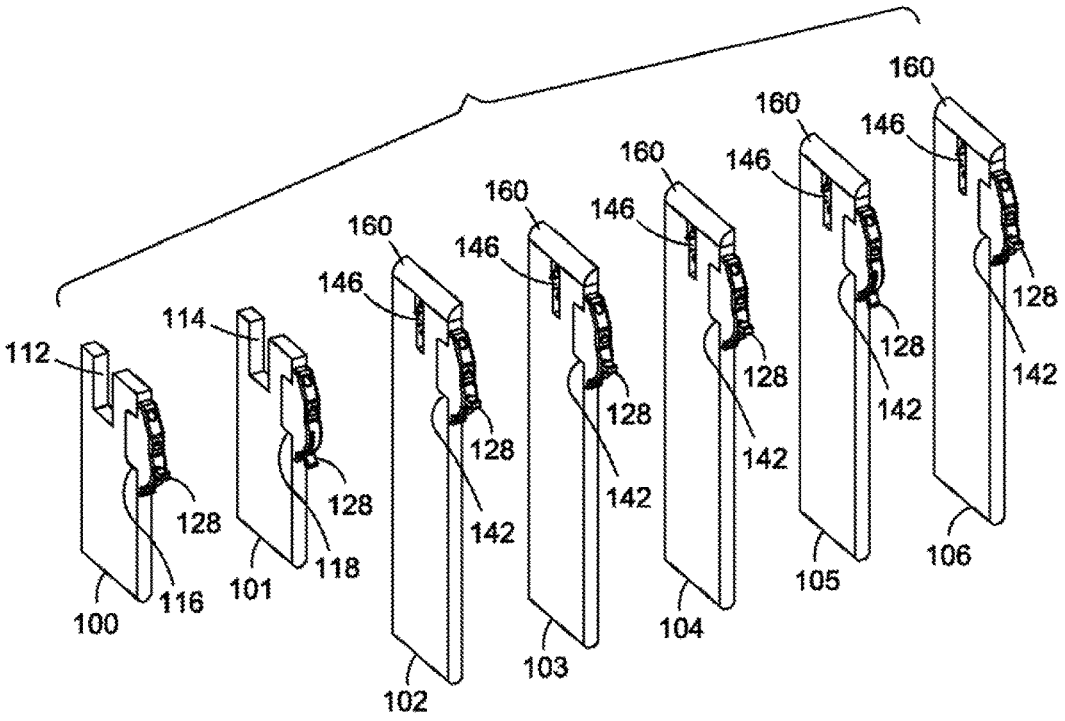
FIG. 8 shows the weight plates from one horizontally extending plurality of weight plates positioned side-by-side one another according to a preferred embodiment of this invention.

Details of the individual weight plates to be lifted and carried by each weight plate carriage 3 of the exercise machine 1 herein disclosed are initially described while referring to FIG. 8 of the drawings. As a unique feature of this invention, the vertically upstanding weight plates are arranged side-by-side in spaced parallel alignment with one another in a horizontally extending plurality of weight plates. A total of seven weight plates are shown in FIG. 7, but the particular number of weight plates to be lifted by carriage 3 during any exercise routine is a matter of choice. The first two weight plates 100 and 101 from the horizontal plurality have an identical length (e.g., ten inches). The first weight plate 100 has an ideal weight of 5 pounds, and the second weight plate 101 has an ideal weight of 10 pounds. The remaining five weight plates 102, 103, 104, 105 and 106 from the horizontal plurality have an identical but longer length (e.g., twenty two inches) relative to weight plates 100 and 101. Each of the weight plates 102-106 has an identical weight of preferably 20 pounds.

Figure 9:
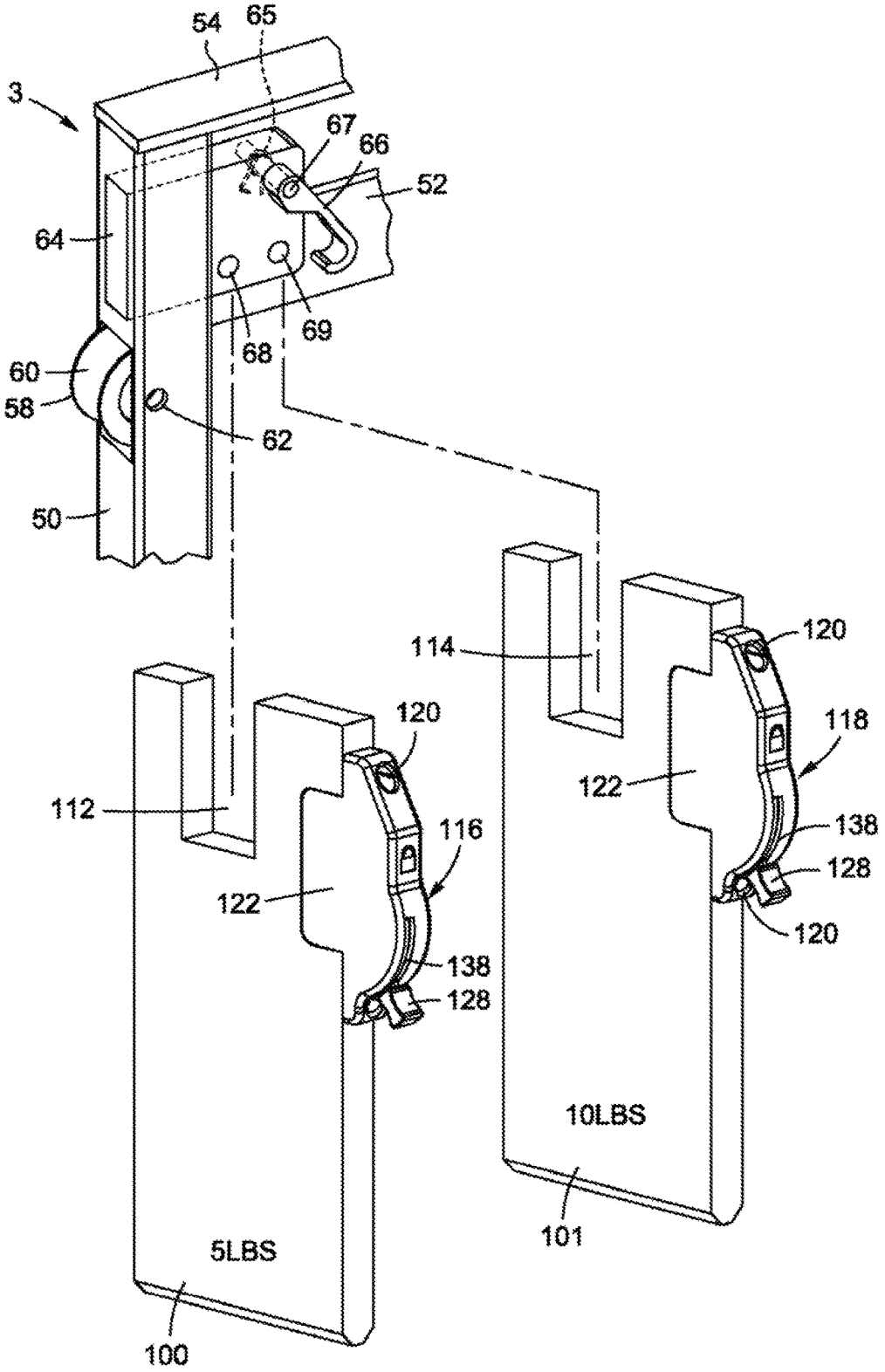
FIGS. 9-11 illustrate first and second weight plates from the horizontally extending plurality of weight plates of FIG. 8 being selectively connected to a weight plate lifting block of the weight plate carriage.
Figure 10:
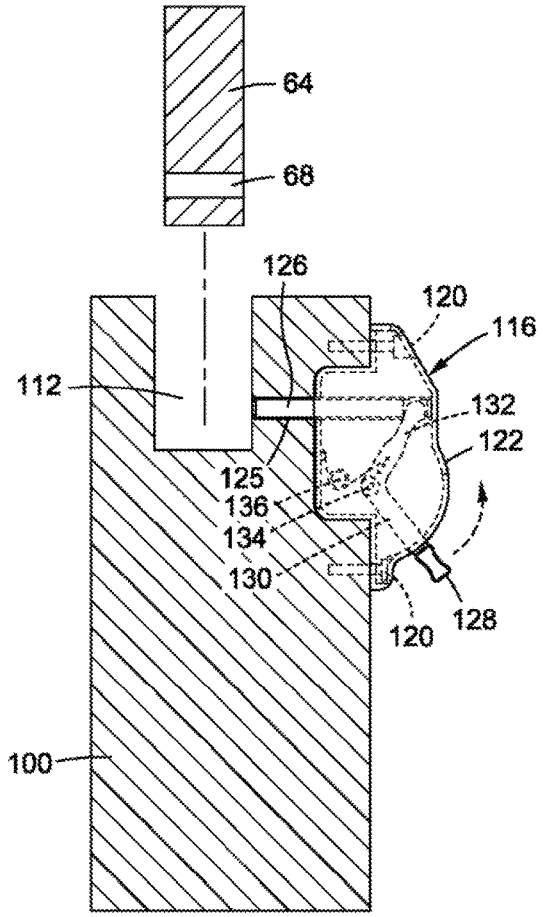
Figure 11:
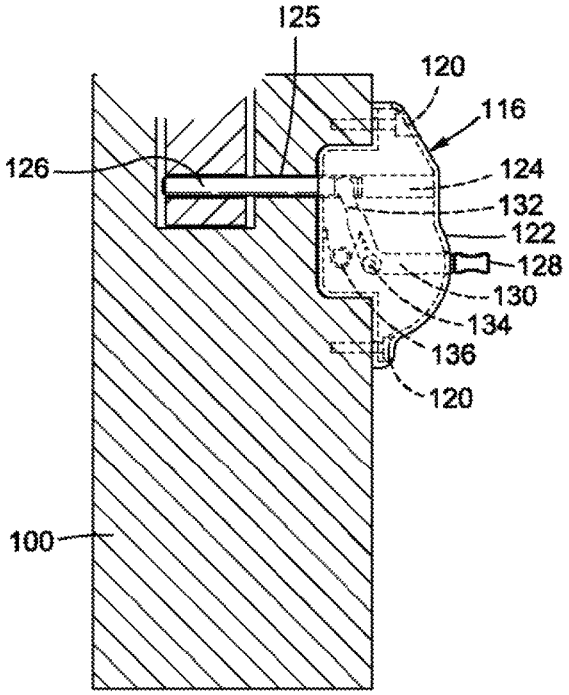

FIGS. 9-11 of the drawings illustrate the first two (i.e., the lightest) weight plate 100 and 101 from the horizontally extending plurality thereof being detachably connected to the weight plate carriage 3 that is located at one side of the exercise machine 1. As was explained when referring to FIG. 3, a weight plate lifting block 64 is affixed to the carriage alignment column 50 which runs along one side of the weight plate carriage 3. As was also explained, the hook-shaped weight plate clasp 66 is pivotally connected to the weight plate lifting block 64 at the top of the weight plate carriage 3 by means of a bolt 67, and a pair of engagement pin receiving holes 68 and 69 are formed though lifting block 64 adjacent the bolt 67.

Each of the first two weight plates 100 and 101 has a respective lifting cavity 112 and 114 extending downwardly from the top thereof and a removable locking cartridge 116 and 118 mounted at one side thereof by a pair of screws 120. The lifting cavities 112 and 114 of weight plates 100 and 101 are sized to receive therewithin the weight plate lifting block 64.

Each of the locking cartridges 116 and 118 that is mounted at one side of respective weight plates 100 and 101 is identical to one another tend similar to that described in my U.S. Pat. No. 8,047,970 issued Nov. 1, 2011, the teachings of which are incorporated herein by reference. Therefore, only a brief description of one of the identical locking cartridges (e.g., 116) will be described with respect to the weight plate 100 when referring particularly to FIGS. 10 and 11.

The locking cartridge 116 includes a lock body 122. A longitudinal engagement pin channel 124 (best shown in FIG. 11) extends through the lock body 122 towards the lifting cavity 112 that is formed in weight plate 100. An engagement pin 126 is slidable reciprocally through the engagement pin channel 124 in the lock body 122 between a retracted position shown in FIG. 10 at which the weight plate 100 is detached from the weight plate lifting block 64 received within the lifting cavity 112 and an axially extended position shown in FIG. 11 at which the weight plate 100 is detachably connected to the weight plate lifting block 64.

A user actuated control knob (i.e., switch) 128 communicates with one end of the engagement pin 126 by way of a pair of rotatable engagement pin positioning arms 130 and 132. First ends of the positioning arms 130 and 132 are pivotally coupled to one another at a pivot pin 134 located inside the lock body 122 of locking cartridge 116. The opposite end of one engagement pin positioning arm 130 is connected to the control knob 128. The opposite end of the other engagement pin positioning arm 132 is coupled to the engagement pin 126 at a cavity thrilled therein. The engagement pin positioning arm 132 communicates with a torsion (e.g., coil) spring 136 within the lock body 122 of locking cartridge 116 to urge the positioning arm 132 to rotate in a clockwise direction around the pivot pin 134 and thereby cause the engagement pin 126 to be normally biased to the aforementioned retracted position of FIG. 10 so as to be withdrawn within the longitudinal engagement pin channel 124.

The control knob 128 is adapted to slide back and forth between locked and unlocked positions along a guide slot 138 (best shown in FIG. 9) through the lock body 122 of the locking cartridge 116. Depending upon whether the weight plate 100 and the particular weight (5 pounds) thereof is to be connected to the weight plate lifting block 64 and lifted by the weight plate carriage 3, the engagement pin 126 is moved axially through the engagement pin channel 124 formed in the lock body 122 towards one of its retracted or extended positions in response to a pushing or pulling force applied by the user to the control knob 128. The weight plate 100 is connected to the lifting block 64 when the control knob 128 is pushed through guide slot 138 to its locked position and the engagement pin 126 is correspondingly moved to its extended position (of FIG. 11) for receipt within a locking channel 125 which runs through weight plate 100 and the engagement pin receiving hole 68 that is formed in lifting block 64 and axially aligned with locking channel 125.

The same technique as just described for weight plate 100 is used if the second weight plate 101 shown in FIG. 9 and the particular weight (10 pounds) thereof were to be detachably connected to the lifting block 64 to be lifted by the weight plate carriage 3. In this case, with the lifting block 64 located within the lifting cavity 114 of weight plate 101, the control knob 128 of the locking cartridge 118 can be pushed through guide slot 136 to its locked position so that the engagement pin from locking cartridge 118 will be moved to its extended position for receipt by the engagement pin receiving hole 69 that is formed in the lifting block 64 adjacent the pin receiving hole 68.

Turning now to FIGS. 12-16 of the drawings, details are provided by which any one or more of the remaining identical 20 pound weight plates 102-106 from the horizontally extending plurality thereof shown in FIG. 8 are detachably connected to the weight plate carriage 3 of the exercise machine 1. Each of the remaining weight plates (e.g., 102) includes an identical removable locking cartridge 142 that is mounted within a cartridge cavity 143 located at one side of the weight plate and held in place by a pair of screws 144. The locking cartridge 142 shown in FIGS. 12-16 is identical to the locking cartridge designated 116 in FIGS. 10 and 11. Therefore, identical reference numerals will be used for both locking cartridges 116 and 142, so that the details and operation of locking cartridge 142 will not be explained once again.

Figure 12:
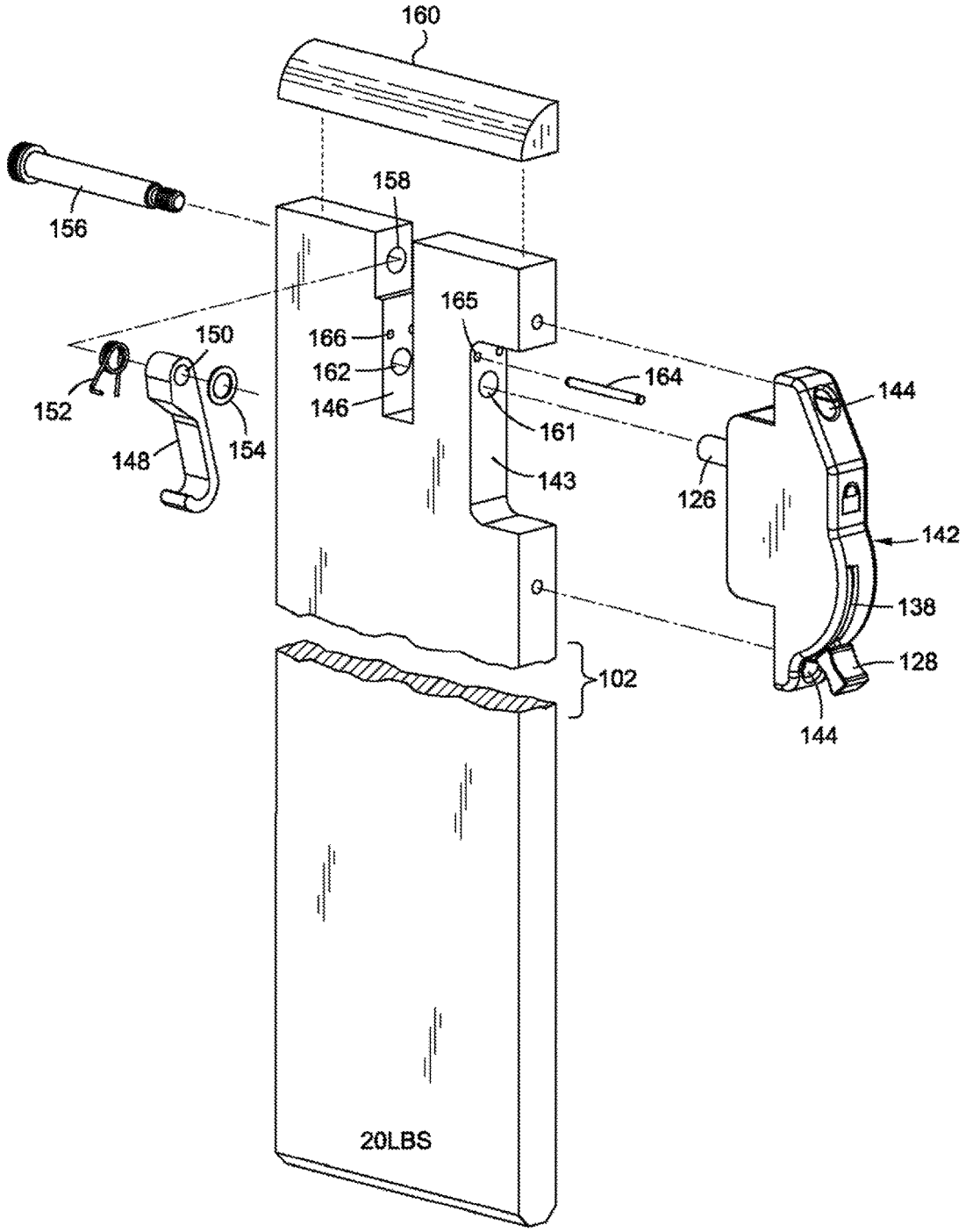
FIGS. 12-16 illustrate details of each of the third and succeeding weight plates from the horizontally extending plurality of weight plates of FIG. 8.
Figure 13:
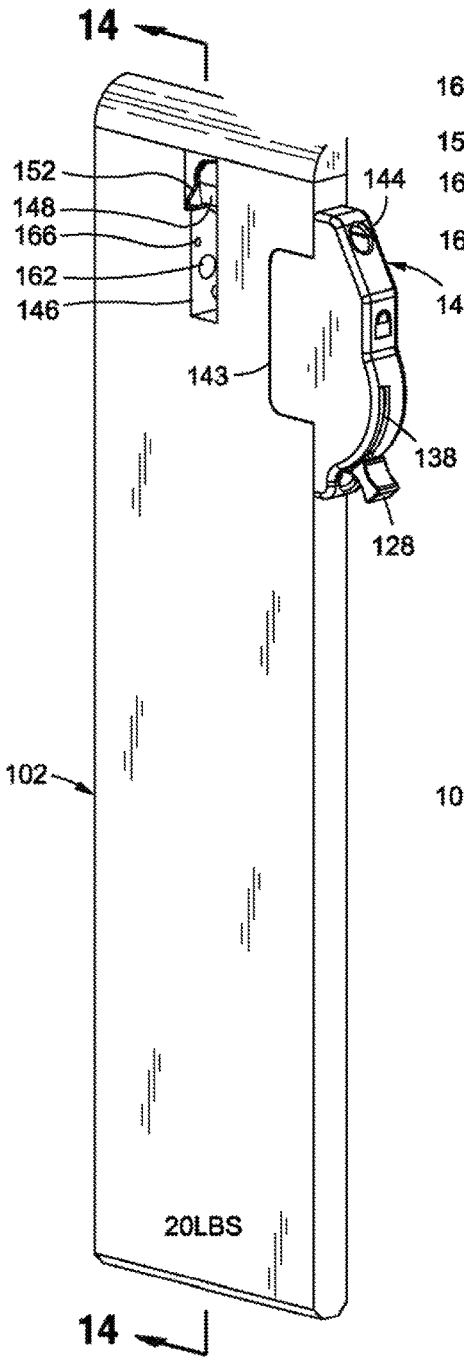
Figure 14:
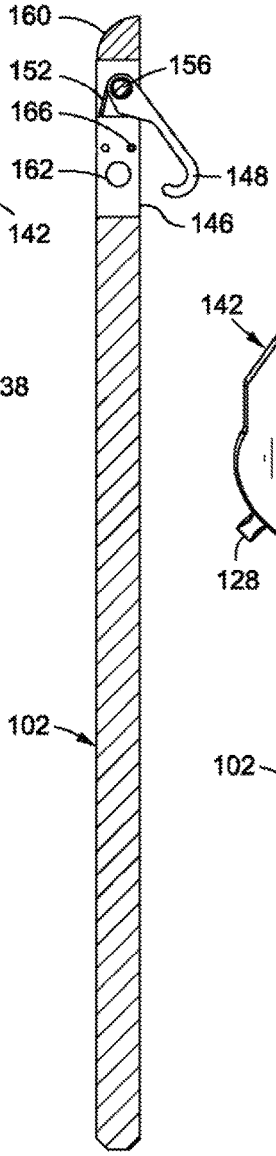
Figure 16:
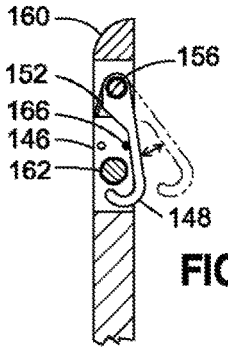
Figure 15:
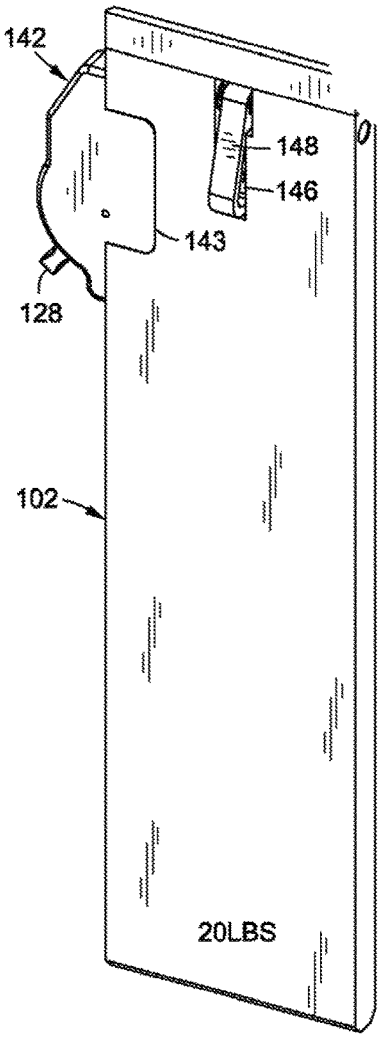

A hook retaining cavity 146 extends downwardly from the top of the weight plate 102. Located within the cavity 146 is a hook-shaped weight plate clasp 148 which is identical to the hook-shaped clasp 66 that is shown in FIG. 3 and connected to the weight plate lifting block 64 affixed to the weight plate carriage 3. As is best shown in FIG. 12, a hole 150 formed through the top of the weight plate clasp 148 is axially aligned with a torsion (e.g., coil) spring 152 at one side of clasp 148 and a ring-shaped washer 154 at the opposite side for receipt therethrough of a threaded shoulder bolt 156. The shoulder bolt 156 is received through a bolt hole 158 formed in the top of the weight plate 102 so as to run through the weight plate clasp 148 and laterally across the top of the hook retaining cavity 146. Thus, and as is best shown in FIGS. 13-16, the shoulder bolt 156 connects the weight plate clasp 148 to the weight plate 102 within the cavity 146 thereof and establishes a pivot axis around which the weight plate clasp 148 can rotate. The torsion spring 152 is located within the hook retaining cavity 146 of weight plate 102 at which to engage and rotate the clasp 148 around shoulder bolt 156 and outwardly from cavity 146 (best shown in FIG. 14).

Seated on the top of the weight plate 102 so as to lie over and cover the hook retaining cavity 146 thereof is a curved hook-deflecting strike plate 160, the advantage of which will soon be described. A pair of engagement pin channels 161 and 162 are axially aligned with one another through the weight plate 102 at the opposite sides of the hook retaining cavity 146 (best shown in FIG. 12). When the locking cartridge 142 is secured to the weight plate 102 within the cartridge cavity 143 at one side thereof, the engagement pin 126 is slidable between retracted and extended positions depending upon whether a pushing or a pulling force is applied to the control knob 128 of cartridge 142.

When the weight plate 102 for any of the other weight plates 103-106 from the horizontal plurality of FIG. 8) and the particular weight (20 pounds) thereof is to be lifted by the weight plate carriage 3, the control knob 128 of the locking cartridge 142 is pushed along the guide slot 138 to its locked position. Pushing the control knob 128 correspondingly causes the engagement pin 126 to move outwardly from cartridge 142 to its extended position at which to be received through the axially aligned engagement pin channels 161 and 162 and thereby capture the hook-shaped weight plate clasp 148 within the hook retaining cavity 146. When it is desirable to disconnect the weight plate 102 from the weight plate carriage 3, the control knob 128 of the locking cartridge 142 is pulled through the guide slot 138 to its unlocked position. Pulling the control knob 128 in an opposite direction correspondingly causes the engagement pin 128 to move inwardly of cartridge 142 to its retracted position at which to be separated from and release the weight plate clasp 148.

A roll pin 164 (best shown in FIG. 12) extends outwardly from the locking cartridge 142 through a pair of roll pin channels 165 and 166 that are axially aligned with one another through the weight plate 102 at opposite sides of the hook retaining cavity 446. The roll pin 164 is positioned within the hook retaining cavity 146 of weight plate 102 at which to engage the weight plate clasp 148 and thereby limit the rotation of the clasp through the cavity 146.

Figure 17:
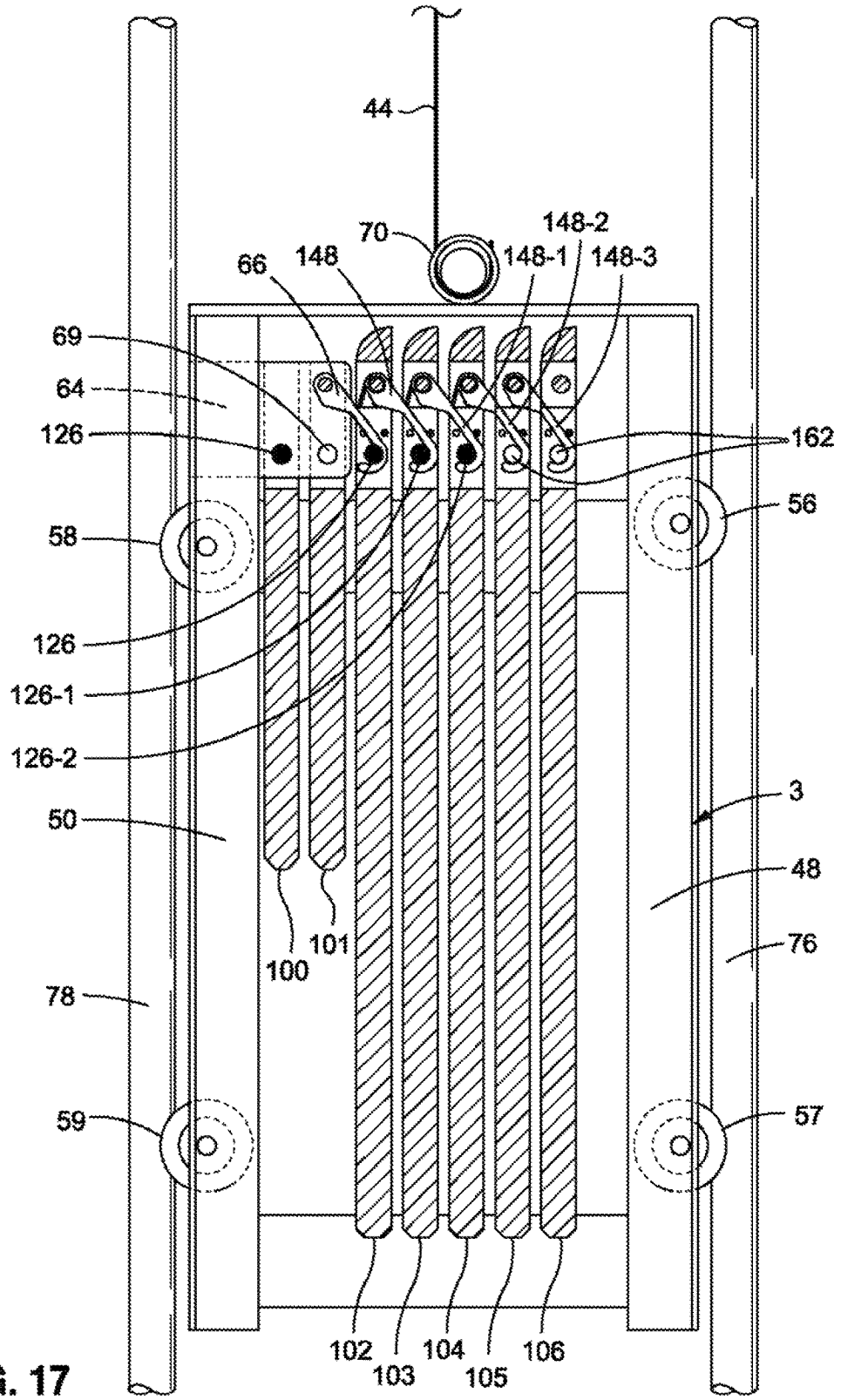
FIG. 17 is a partial cross-section of the horizontally extending weight plates with, for example, the first, third, fourth and fifth weight plates from the plurality of weight plates being selectively coupled to the weight plate carriage when the carriage is at-rest.
Figure 18:
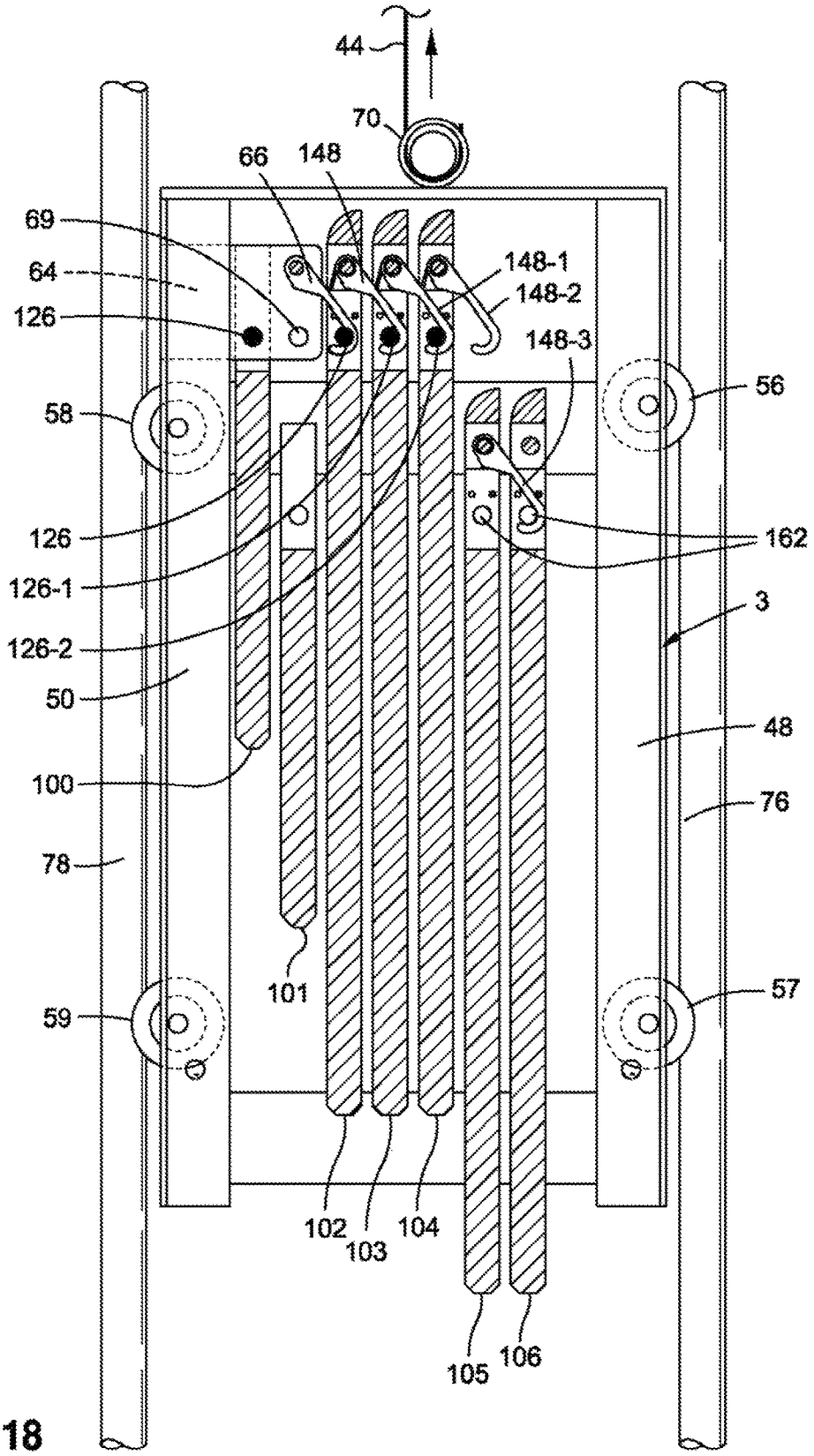
FIG. 18 shows the weight plate carriage and the weight plates selectively connected thereto as shown in FIG. 17 being lifted in the vertical direction in response to an uplifting pulling force being applied to the carriage.
Figure 19:
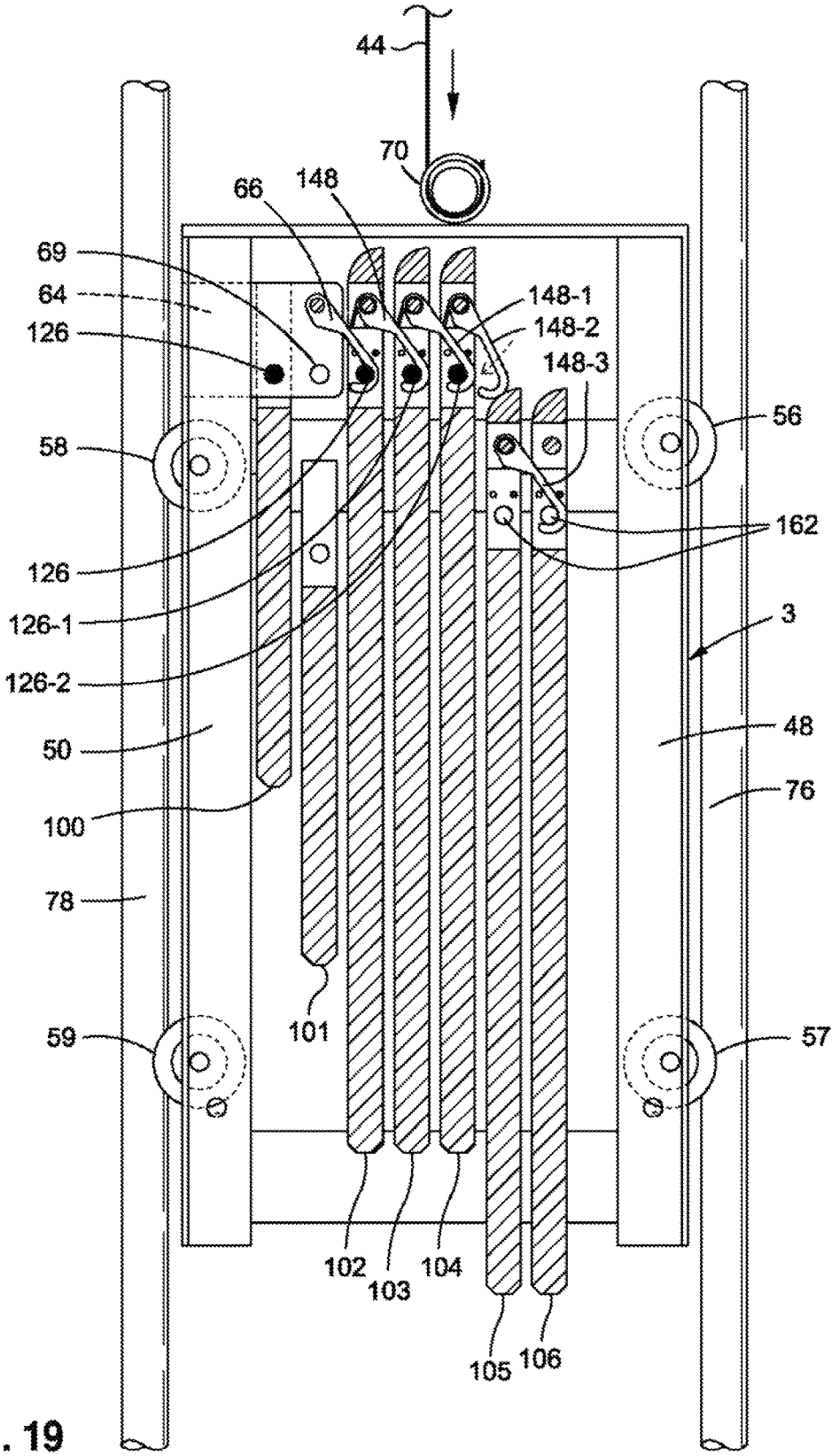
FIG. 19 shows the weight plate carriage and the weight plates selectively connected thereto as shown in FIG. 18 being lowered after the uplifting pulling force that was previously applied to the carriage has been terminated.

The manner by which any one or more of the weight plates 100-106 from the horizontally extending plurality of weight plates shown in FIG. 8 are selectively coupled to and lifted by one of the pair of weight plate carriages 3 of the exercise machine 1 is now described when referring to FIGS. 17-19 of the drawings. As was previously explained, the first weight plate 100 from the horizontally extending plurality has a weight of 5 pounds, the second weight plate 101 has a weight of 10 pounds, and each of the third-seventh weight plates 102-106 has an identical weight of 20 pounds. Therefore, depending upon the number of weight plates that are selectively coupled to and lifted by the weight plate carriages 3 at opposite sides of the weight plate retention housing 4 of the exercise machine 1 shown in FIGS. 1 and 2, the user can lift between 5 to 115 pounds in 5 pounds increments with each arm as he applies successive pulling forces to the handles 28 of the machine 1 during his exercise routine.

FIG. 17 shows, for example, the weight plates 100, 102, 103 and 104 from the horizontally extending plurality of weight plates being selectively coupled to one weight plate carriage 3 located at one side of the weight plate retention housing 4 of the exercise machine 1 so that a total of 65 pounds will be lifted by one arm of the user when he applies a pulling force to one handle 28 of the machine. In this example, the other weight plates 101, 105 and 106 are not coupled to or lifted by the weight plate carriage 3.

Referring to FIGS. 9-11 and 17 of the drawings, the weight plate 100 is shown coupled to the weight plate carriage 3 when the control knob 128 of the locking cartridge 116 is pushed through the guide slot 138 from its unlocked position shown in FIG. 10 to its locked position shown in FIG. 11. Pushing the control knob 128 of the locking cartridge 116 to the locked position causes the engagement pin 126 to correspondingly move through the engagement pin channel 124 formed in the lock body 122 of locking cartridge 116 and the axially aligned locking channel 125 formed in the weight plate 100 for receipt by the engagement pin receiving hole 68 formed in the weight plate lifting block 64, whereby the weight plate 100 is detachably connected to the lifting block 64 and to the top of the weight plate carriage 3 to which the lifting block 64 is affixed.

With respect to the weight plate 101, the control knob 128 of the locking cartridge 118 of FIG. 9 is left in place in its unlocked position. In this case, the engagement pin 126 remains retracted within the engagement pin channel 124 formed in the lock body 122 of cartridge 118, whereby the engagement pin 126 lies outside the engagement pin receiving hole 69 formed in the weight plate lifting block 64, such that the weight plate 101 is disconnected from the weight plate carriage 3.

Referring to FIGS. 12-17 of the drawings, in addition to the weight plate 100, each of the weight plates 102, 103 and 104 is also shown selectively coupled to the weight plate carriage 3 when the respective control knobs (128 in FIG. 8) of the locking cartridges (142 in FIG. 8) that are associated with weight plates 102-104 are pushed through guide slots 138 from their unlocked position (as shown) to their locked position. As an important feature of this invention for enabling the user to selectively couple some or all of the weight plates 100-106 to the weight plate carriage 3, and as is best shown in FIG. 17, each of the hook-shaped weight plate clasps (e.g., 148) that are pivotally connected to weight plates 102-104 is biased (i.e., pushed) by its torsion spring 152 (of FIGS. 13-16) so as to rotated into the hook retaining cavity 146 that is formed in the succeeding weight plate lying immediately in front thereof.

It may be observed from FIG. 17 that neither the first nor the last weight plates 100 and 106 has a weight plate clasp (i.e., book) connected thereto. Moreover, the clasp 66 that is pivotally connected to the weight plate lifting block 64 of the weight plate carriage 3 is rotated by a torsion (e.g., coil) spring 65 (of FIG. 9) forwardly of weight plate 101 and into the hook retaining cavity 146 (of FIG. 14) of weight plate 102 to be captured by the engager eat pin 126 of locking cartridge 142 (of FIG. 12) of weight plate 102. What is more, and as may also be observed from FIG. 17, the rotatable clasp 148 pivotally connected to weight plate 102 is pushed by its torsion spring 152 (of FIG. 12) so as to rotate forwardly and into the hook retaining cavity of weight plate 103, the rotatable clasp 148-1 pivotally connected to weight plate 103 is rotated into the hook retaining cavity of the weight plate 104, the rotatable clasp 148-2 pivotally connected to weight plate 104 is rotated into the hook retaining cavity of weight plate 105, and the rotatable clasp 148-3 pivotally connected to weight plate 105 is rotated into the hook retaining cavity of weight plate 106.

With the weight plate carriage 3 at-rest as shown in FIGS. 4 and 17, no pulling force is applied to the weight plate carriage lifting cable 44 such that none of the weight plates 100-106 is being lifted by the weight plate carriage 3. When the control knobs 128 of each of the locking cartridges 142 of the weight plates 102-104 (of FIG. 8) are pushed to their locked position, the engagement pins 126, 126-1 and 126-2 from respective ones of the locking cartridges 142 of weight plates 102-104 are correspondingly pushed through their axially aligned engagement pin channels 161 and 162 (of FIG. 12). The engagement pins 126, 126-1 and 126-2 thusly capture the hook-shaped weight plate clasps 66, 148 and 148-1 that are located within the hook retaining cavities 146 of those weight plates 102, 103 and 104 that are selected by the user to be lifted by the weight plate carriage 3.

FIGS. 5, 6 and 18 show the weight plate carriage 3 being lifted in the vertical direction through the weight plate retention housing 4 of FIGS. 1 and 2 relative to the carriage stabilizer posts 76 and 78 when an upward pulling force is applied to the weight plate lifting cable 44 in response to the user applying a pulling force to one of the handles 28 of the exercise machine 1 as shown in FIG. 1. As previously explained, when the carriage 3 is pulled upwardly, the pairs of upper and lower rollers 56, 57 and 58, 59 thereof roll along the carriage stabilizer posts 76 and 78. Because they are coupled to the weight plate carriage 3 by way of the weight plate lifting block 64 and the weight plate clasps 66, 148 and 148-1, the weight plates 100, 102, 103 and 104 will all be simultaneously lifted. Because they are not coupled to the weight plate carriage 3 at the weight plate lifting block 64 thereof, the remaining weight plates 101, 105 and 106 will not be lifted and will remain stationary during the exercise routine.

Of course, and without having to leave his seat (22 of FIG. 2), the user can selectively change the number of weight plates 100-106 that are coupled to and lifted by the weight plate carriage 3 to increase or decrease the weight to be tilled during his exercise routine. The foregoing is accomplished by simply pushing or pulling different ones of the control knobs 128 of the locking cartridges 116, 118 and 142 (of FIG. 8) to their locked or unlocked positions.

FIG. 19 of the drawings shows the weight plate carriage 3 being lowered by gravity relative to the carriage stabilizer posts 76 and 78 when the user terminates the pulling force applied to the handle 28 which in turn terminates the upward pulling three being applied to the weight lifting cable 44. Because the weight plate 105 was not lifted, the hook-shaped weight plate clasp 148-2 that is pivotally connected to and rotated outwardly from the preceding weight plate 104 is not captured by the engagement pin from the locking cartridge 142 (of FIG. 8) carried by the succeeding weight plate 105. Thus, the hook end of the weight plate clasp 148-2 remains free in front of the weight plate 104.

As the weight plate carriage 3 is lowered towards its at-rest position of FIG. 17, the outwardly rotated weight plate clasp 148-2 moves into contact with the curved hook-deflecting strike plate (designated 160 in FIG. 16) at the top of weight plate 105. The curved strike plate 160 urges the clasp 148-2 to momentarily rotate rearwardly against the normal bias of the torsion spring 152 (of FIG. 16) towards the preceding weight plate 104 by which to enable all of the uplifted weight plates 100, 102, 103 and 104 to move downwardly towards those weight plates 101, 105 and 106 which were not lifted. Once the weight plate carriage 3 is lowered to its at-rest position of FIG. 17, the torsion spring 152 (of FIG. 16) will automatically expand and push the weight plate clasp 148-2 forwardly towards and into the hook retaining cavity 146 of the adjacent weight plate 105 as shown in FIG. 17.

The invention claimed is:

1. An exercise machine comprising:

a plurality of vertically upstanding weight plates being arranged in parallel side-by-side alignment with one another in a horizontal direction;

a weight plate carriage having first and second sides being oppositely positioned to one another and extending in a vertical direction, said weight plate carriage being adapted to lift said plurality of vertically upstanding weight plates in said vertical direction in response to an uplifting force applied to said weight plate carriage, each of said plurality of vertically upstanding weight plates lying between the first and second sides of said weight plate carriage; and connection means by which to selectively connect one or more of said weight plates from said plurality of vertically upstanding weight plates to said weight plate carriage to be lifted in said vertical direction by said weight plate carriage in response to the uplifting force applied thereto, said connection means including an engagement pin receiving hole formed in said weight plate carriage, and wherein a first weight plate from said plurality of vertically upstanding weight plates has a first locking cartridge connected thereto, said first locking cartridge including a first engagement pin and a first control knob that communicates with said first engagement pin, said first control knob being movable from an unlocked position at which said first engagement pin is retracted inwardly of said first locking cartridge to a locked position at which said first engagement pin is pushed by said first control knob so as to extend outwardly from said first locking cartridge for receipt within the engagement pin receiving hole formed in said weight plate carriage by which said first weight plate is connected to said weight plate carriage.

2. The exercise machine recited in claim 1, further comprising a weight plate carriage lifting cable connected to said weight plate carriage by which to apply said uplifting force to said weight plate carriage and thereby cause said weight plate carriage to move upwardly in said vertical direction to lift the one or more of said plurality of vertically upstanding weight plates that are selectively connected thereto.

3. The exercise machine recited in claim 2, further comprising a rotatable lifting arm interconnected with said weight plate carriage lifting cable, said rotatable lifting arm being rotated in response to a pulling force applied thereto for correspondingly generating said uplifting force to be applied to said weight plate carriage by way of said weight plate carriage lifting cable.

4. The exercise machine recited in claim 2, further comprising first and second carriage stabilizer posts respectively positioned adjacent to said first and second sides of said weight plate carriage, said weight plate carriage including at least one roller located at each of the first and second sides of said weight plate carriage to engage and roll on said first and second carriage stabilizer posts, so that said weight plate carriage moves upwardly along said first and second carriage stabilizer posts in the vertical direction in response to the uplifting force applied thereto by said weight plate carriage lifting cable.

5. The exercise machine recited in claim 4, further comprising first and second guide cables, a first cable tie connected to said first side of said weight plate carriage, and a second cable tie connected to the second side of said weight plate carriage, said first guide cable running from said first cable tie at the first side of said weight plate carriage to a first location above said weight plate carriage, then to a second location below said weight plate carriage, and finally to said second cable tie at the second side of said weight plate carriage, and said second guide cable running from said second cable tie at the second side of said weight plate carriage to a third location above said weight plate carriage, then to a fourth location below said weight plate carriage, then to a second location below said weight plate carriage, and finally to said first cable tie at the first side of said weight plate carriage, such that said first and second guide cables move in opposite directions relative to one another at the same time that said weight plate carriage moves upwardly in the vertical direction in response to the uplifting pulling force applied thereto by said weight plate carriage lifting cable.

6. The exercise machine recited in claim 1, wherein at least some of the weight plates from said plurality of vertically upstanding weight plates have a different length and a different weight than a length and weight of other weight plates from said plurality of vertically upstanding weight plates.

7. The exercise machine recited in claim 1, wherein said weight plate carriage includes a weight plate lifting member having said engagement pin receiving hole formed therein, and said first weight plate has a lifting cavity extending therethrough, the weight plate lifting member of said weight plate carriage being received within the lifting cavity of said first weight plate such that said first engagement pin moves outwardly from said first locking cartridge and through said first weight plate for receipt by the engagement pin receiving hole formed in said weight plate lifting member when said first control knob is moved from said unlocked position to said locked position of said first control knob.

8. The exercise machine recited in claim 1, wherein said connection means also includes a weight plate coupler attached to said weight plate carriage and positioned so as to be coupled to a second weight plate from said plurality of vertically upstanding weight plates by which said second weight plate is connected to said weight plate carriage.

9. The exercise machine recited in claim 8, wherein said weight plate coupler is a first hook that is connected to said weight plate carriage, said second weight plate having a second locking cartridge connected thereto, said second locking cartridge including a second engagement pin and a second control knob that communicates with said second engagement pin, said second control knob being movable from an unlocked position at which said second engagement pin is retracted inwardly of said second locking cartridge to a locked position at which said second engagement pin is pushed by said second control knob so as to extend outwardly from said second locking cartridge and capture the first hook that is connected to said weight plate carriage, whereby the second weight plate is connected to said weight plate carriage by way of said first hook.

10. The exercise machine recited in claim 9, wherein said second weight plate has a longer length and a greater weight than a length and weight of said first weight plate.

11. The exercise machine recited in claim 9, wherein said second weight plate has a hook retaining cavity extending therethrough, the first hook that is connected to said weight plate carriage being located within the hook retaining cavity of said second weight plate, such that said second engagement pin moves outwardly from said second locking cartridge and through said second weight plate by which to capture said first hook within the hook retaining cavity of said second weight plate when the second control knob of said second locking cartridge is moved from said unlocked position to said locked position of said second control knob.

12. The exercise machine recited in claim 11, wherein said connection means also includes a second hook connected to said second weight plate within the hook retaining cavity thereof, said second hook extending outwardly from the hook retaining cavity of said second weight plate, and a third weight plate from said plurality of vertically upstanding weight plates of said exercise machine having a third locking cartridge connected thereto, said third locking cartridge including a third engagement pin and a third control knob that communicates with said third engagement pin, said third control knob being movable from an unlocked position at which said third engagement pin is retracted inwardly of said third locking cartridge to a locked position at which said third engagement pin is pushed by said third control knob so as to extend outwardly from said third locking cartridge and capture the second hook that is connected to said second weight plate.

13. The exercise machine recited in claim 12, wherein said third weight plate has a hook retaining cavity extending therethrough, the second hook that is connected to said second weight plate being coupled to a torsion spring which urges said second hook to rotate into the hook retaining cavity of said third weight plate, such that said third engagement pin moves outwardly from said third locking cartridge so as to capture said second hook within the hook retaining cavity of said third weight plate when the third control knob of said third locking cartridge is moved from said unlocked position to said locked position of said third control knob.

14. The exercise machine recited in claim 13, wherein a top of each of said second and third weight plates has a respective curved hook-deflecting strike plate lying over and covering the respective hook retaining cavity thereof.

15. An exercise machine comprising:

a plurality of weight plates; and a weight plate carriage adapted to lift said plurality of weight plates in a vertical direction in response to a vertical uplifting force applied thereto, wherein a first weight plate from said plurality of weight plates having a first weight and being detachably connected to said weight plate carriage, a second weight plate from said plurality of weight plates having a second weight and being detachably connected to said weight plate carriage by means of a first hook extending between said second weight plate and said weight plate carriage, and a third weight plate from said plurality of weight plates having a third weight and being detachably connected to said second weight plate by means of a second hook extending between said second and third weight plates, whereby said first, second and third weight plates are simultaneously lifted by said weight plate carriage when said vertical uplifting force is applied thereto, and wherein said first, second and third weights are different.

16. The exercise machine recited in claim 15, wherein said plurality of weight plates stand vertically upward and are arranged in parallel side-by-side alignment with one another in a horizontal direction.

17. The exercise machine recited in claim 16, wherein said first weight plate is detachably connected to said weight plate carriage by means of a slidable engagement pin carried by said first weight plate and sliding through a locking channel formed in said first weight plate and into receipt by an axially aligned engagement pin hole formed in said first weight plate carriage.

18. The exercise machine recited in claim 15, wherein said first and second weight plates have an identical length different from a length of said third weight plate.

19. The exercise machine recited in claim 15, wherein the second hook of said second weight plate has first and second ends, opposite to one another, with said first end pivotally connected to said second weight plate and a clasp located at said second end, the second end of said second hook being rotated by a spring carried by said second weight plate to cause the clasp at said second end to rotate towards and into engagement with said third weight plate.

20. An exercise machine comprising:

a plurality of vertically upstanding weight plates being arranged in parallel side-by-side alignment with one another in a horizontal direction;

a weight plate carriage having first and second sides being oppositely positioned to one another and extending in a vertical direction, said weight plate carriage being adapted to lift said plurality of vertically upstanding weight plates in said vertical direction in response to an uplifting force applied to said weight plate carriage;

connection means by which to selectively connect one or more of said weight plates from said plurality of vertically upstanding weight plates to said weight plate carriage to be lifted in said vertical direction by said weight plate carriage in response to the uplifting force applied thereto; a weight plate carriage lifting cable connected to said weight plate carriage by which to apply said uplifting force to said weight plate carriage and thereby cause said weight plate carriage to move upwardly in said vertical direction to lift the one or more of said plurality of vertically upstanding weight plates that are selectively connected thereto; and first and second guide cables, a first cable tie connected to the first side of said weight plate carriage, and a second cable tie connected to the second side of said weight plate carriage, said first guide cable running from said first cable tie at the first side of said weight plate carriage to a first location above said weight plate carriage, then to a second location below said weight plate carriage, and finally to said second cable tie at the second side of said weight plate carriage, and said second guide cable running from said second cable tie at the second side of said weight plate carriage to a third location above said weight plate carriage, then to a fourth location below said weight plate carriage, and finally to said first cable tie at the first side of said weight plate carriage, such that said first and second guide cables move in opposite directions relative to one another at the same time that said weight plate carriage moves upwardly in the vertical direction in response to the uplifting pulling force applied thereto by said weight plate carriage lifting cable.

* * * * *